US006405946B1

(12) United States Patent
Harata et al.

(10) Patent No.: US 6,405,946 B1
(45) Date of Patent: Jun. 18, 2002

(54) FLUID INJECTION NOZZLE

(75) Inventors: Akinori Harata, Toyohashi; Yukio Sawada, Anjo, both of (JP)

(73) Assignee: Denso Corporation (JP)

( * ) Notice: Subject to any disclaimer, the term of this patent is extended or adjusted under 35 U.S.C. 154(b) by 14 days.

(21) Appl. No.: 09/629,939

(22) Filed: Aug. 1, 2000

(30) Foreign Application Priority Data

Aug. 6, 1999 (JP) ..... 11-224141

(51) Int. Cl.[7] ..... F02M 61/00
(52) U.S. Cl. ..... 239/533.12; 239/596
(58) Field of Search ..... 239/596, 533.12

(56) References Cited

U.S. PATENT DOCUMENTS 4,907,748 A 3/1990 Gardner et al.
4,925,111 A * 5/1990 Foertsch et al. ..... 239/533.12
5,762,272 A 6/1998 Tani et al.
5,921,474 A * 7/1999 Zimmermann et al. . 239/596 X
6,170,763 B1 * 1/2001 Fuchs et al. ..... 239/533.12

FOREIGN PATENT DOCUMENTS

| | | |
|---|---|---|
| DE | 19636396 | 3/1998 |
| JP | 11-200998 | 7/1999 |
| WO | 98/34026 | 8/1998 |

* cited by examiner

*Primary Examiner*—Lesley D. Morris
(74) *Attorney, Agent, or Firm*—Nixon & Vanderhye PC

(57) ABSTRACT

A fuel injector has a chamber between a valve body and a plate in which a plurality of through holes are formed. The chamber has a diameter larger than that of an opening of the valve body. The through holes are opened at an outer chamber area shaded by the valve body are distanced from an outer wall of the chamber more than a diameter of the through hole. Fuel flowing along an inner inclined surface of the valve body turns to the through holes and flows into the through hole from all directions and collides with each other at inlets of the through hole. Therefore, injected fuel has a lot of turbulences and is finely atomized.

20 Claims, 7 Drawing Sheets

FLUID INJECTION NOZZLE

CROSS REFERENCE TO RELATED APPLICATION

This application is based on Japanese Patent Application No. Hei 11-224141 filed on Aug. 6, 1999, the content of which is incorporated herein by reference.

BACKGROUND OF THE INVENTION

1. Field of the Invention

The present invention relates to a fluid injection nozzle having a plate in which a fluid injection hole is formed. For instance, the present invention applies to a fuel injection valve for supplying fuel to an internal combustion engine (engine).

2. Description of Related Art

DE 19636396A1 discloses fuel injector having a plate in which a plurality of through holes are formed as fuel injection orifices. Such a plate type injectors are effective to generate a plurality of fuel jets. In this arrangement, fuel flows along an inclined surface formed by a valve seat. However, some of the through holes are opened on an imaginary line where a surface of the plate crosses an extended line of the inclined surface. Therefore, fuel flowing along the inclined surface directly flows into the through holes. Therefore, fuel is insufficiently atomized.

U.S. Pat. No. 4,907,748, U.S. Pat. No. 5,762,272 and WO 98/34026 disclose the fuel injectors having flat chambers just upstream the through holes. Such a chamber provides a compound fuel flow just upstream the through hole and is effective to atomize fuel. However, there is a possibility to spoil an atomization by a collision of injected fuel columns at just after the through holes. Here, the fuel column is a shape of fuel before fuel is atomized by collision with air. Further, a shape of a wall defining the chamber is important to define a fuel flow at an inlet of the through hole, since the fuel atomization is affected by the fuel flow flowing along the plate. However, WO 98/34026 does not provide a surface having a sufficient flatness and a size to atomize fuel.

SUMMARY OF THE INVENTION

The present invention addresses these drawbacks by providing an improved fluid injection nozzle arrangement.

It is therefore an object of this invention to improve an atomization of fluid.

It is a further object of this invention to provide a fluid injection nozzle in which a collision of injected fluid columns is avoided.

According to a first aspect of the present invention, the fluid injection nozzle has a chamber for controlling a fluid flow to a through hole formed on a plate. Fluid flowing along an inner surface of a valve body is inclined to meet and collide at a center region of the plate. Therefore, fluid turns its direction and flows along the plate. Specifically, the chamber is flat and is extended more than a diameter of the through hole at an outside of the through hole. Therefore, fluid flows along the chamber for a sufficient distance and reaches the through hole from all directions and collides at an inlet of the through hole. As a result, fluid injected from the through hole has a lot of turbulences and is finely atomized. Further, an inlet of the through hole opens at an outer area of a projected area which is defined by projecting a downstream end opening of the inner surface of the valve body. Therefore, the through holes are separately arranged to avoid a collision of columns of fluid injected from the through holes.

According to another aspect of the present invention, a plate has an inner through hole and an outer through hole located both side of an imaginary line. Here, the imaginary line is defined by crossing a surface of the plate and a line extended along the inner surface of the valve body. Therefore, the inner through hole and the outer through hole are mainly influenced by fluid flows having different directions. As a result, columns of injected fluid are directed in different directions and a collision of the columns is avoided.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Preferred embodiments of the present invention will be explained with reference to the drawings.

Figure 1:
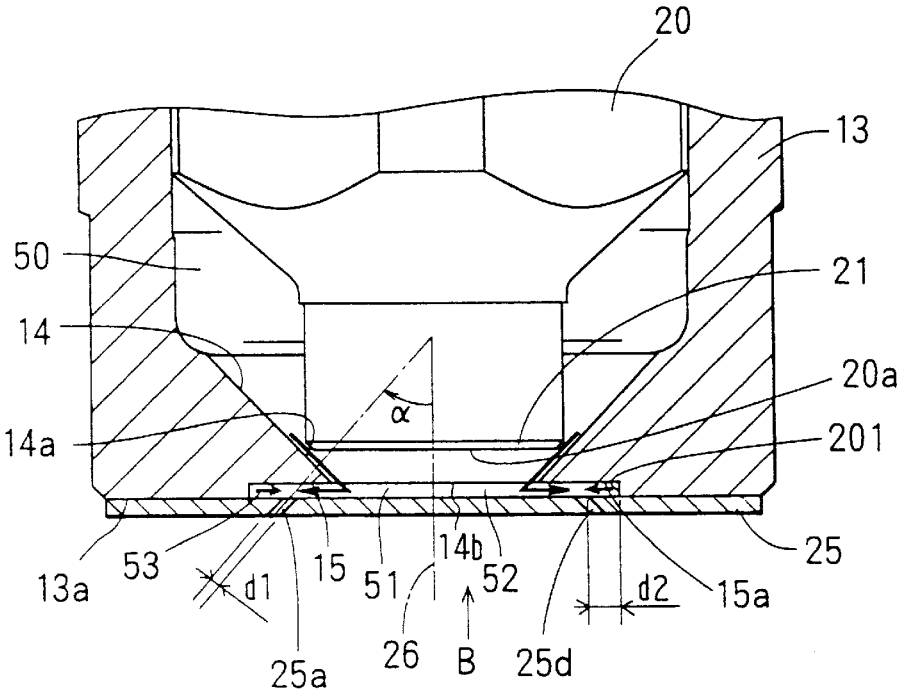
FIG. 1 is a partial sectional view of a nozzle portion of a fuel injector according to a first embodiment of the present invention.
Figure 2:
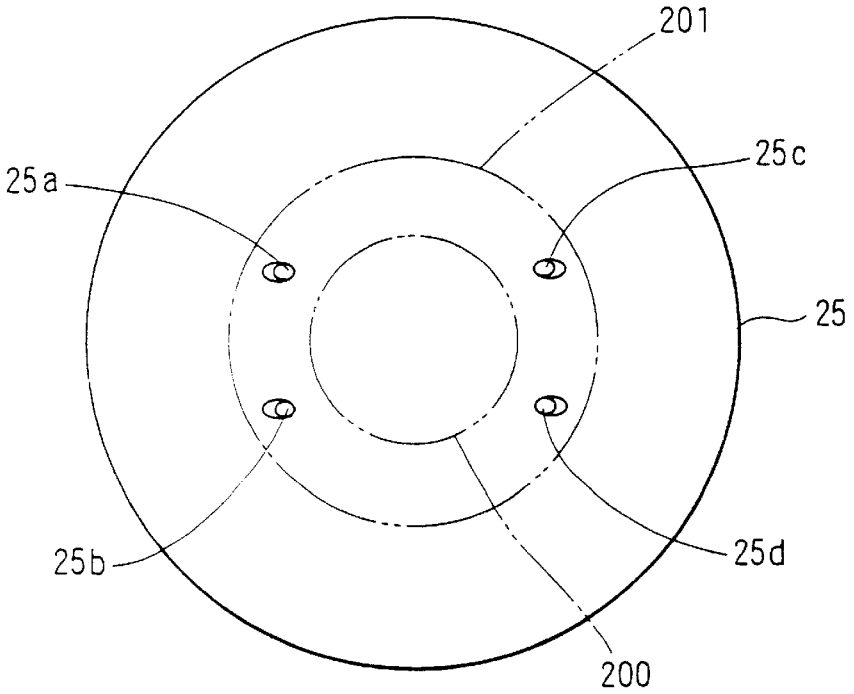
FIG. 2 is a bottom view of a plate according to the first embodiment of the present invention.
Figure 3:
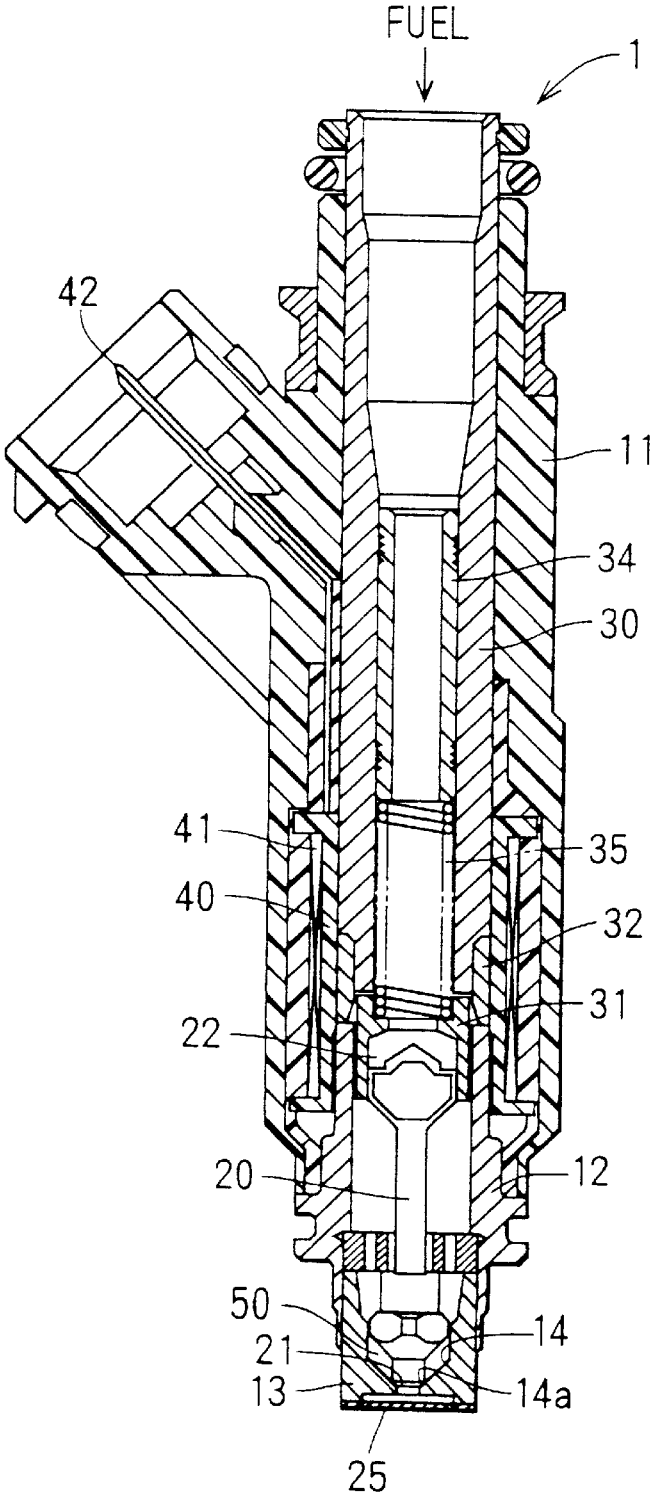
FIG. 3 is a sectional view of the fuel injector according to the first embodiment of the present invention.

FIG. 1 through FIG. 3 shows a first embodiment of the present invention. In this embodiment, the present invention applies to a fuel injector for supplying fuel to an internal combustion engine such as a gasoline engine.

Referring to FIG. 3, the fuel injector 1 has a cylindrical stator core 30 for providing a fuel passage therein. The stator core 30 is connected to a first pipe 32 made of nonmagnetic material by a laser welding. The first pipe 32 is connected to a second pipe 12 made of magnetic material by a laser welding. The second pipe 12 is connected to a valve body 13 by a laser welding. An electromagnetic coil having a spool 40 and a coil 41 is disposed on an outside of the stator core 30, and the first and second pipes 32 and 12. The coil 41 has a pair of terminals that are connected to connector pins 42 respectively. The coil 41 and the stator core 30 are covered with a resin 11 forming an outer body and a connector housing.

A movable valve member is disposed between the stator core 30 and the valve body 13. The movable valve member has a needle 20 and an armature core 31 made of a magnetic material. The armature core 31 is connected to an upper end of the needle 20 and is guided on an inner surface of the first pipe 32 in a slidable manner. A spring 35 is disposed between the armature core 31 and an adjust pipe 34 adjustably fixed on an inner surface of the stator core 30. The needle 20 has an annular contact portion 21 and a flat end surface 20*a* on its bottom end and is guided on an inner surface of the valve body 13. The annular contact portion 21 contacts with a valve seat 14*a* formed on an inner surface 14 of the valve body 13.

Referring to FIG. 1 and FIG. 2, the inner surface 14 provides a funnel-shaped fuel passage 50 of which a cross section decreases toward a downstream side. The inner surface 14 defines an opening 14*b* at a downstream end. A diameter of the opening 14*b* is smaller than that of the annular contact portion 21. The valve body 13 has a shallow and circular shaped depression on its bottom surface. The depression 15 has a diameter 201 larger than that of the opening 14*b*. A cylindrical outer wall and a flat bottom surface 15*a* surrounding the opening 14*b* define the depression 15.

A circular plate 25 is fixed on a bottom surface 13*a* of the valve body 13 by a laser welding. The plate 25 covers the depression 15 and defines a chamber 51 between the plate 25 and the valve body 13. The chamber 51 is thin, circular-shaped, and extended parallel with the plate 25. The plate 25 provides an approximately flat wall defining a downstream wall of the chamber 51. The plate 25 provides the flat wall extending throughout the chamber 51. The chamber 51 is divided into an inner chamber 52 and an outer chamber 53 by a projected line 200. The projected line 200 is defined by projecting the opening 14*a* on the plate 25 in an axial direction.

The plate 25 has a plurality of through holes 25*a*, 25*b*, 25*c*, and 25*d* as fuel orifices for defining a flow rate of fuel.

The through holes 25*a* to 25*d* have the same diameter d1 and are arranged on a circle having a larger diameter than that of the contact portion 21 and the projected line 200. Each of the through holes is inclined to apart from an axis 26 of the plate 25 and the injector 1. The through holes 25*a* and 25*b* are inclined at the same angle $\alpha$ and the through holes 25*c* and 25*d* are inclined at the same angle $\alpha$ in an opposite direction. Therefore, the injector 1 provides two directional fuel injections. In this embodiment, the inclined angle $\alpha$ is set within 2° to 40° ($2° \leqq \alpha \leqq 40°$).

Each of the through holes 25*a* to 25*d* has an inlet opened between the projected line 200 and an outer line 201. Therefore, the inlets of the through holes 25*a* to 25*d* faces the bottom surface 15*a* of the valve body 13 and are shaded in an axial direction. Each of the through holes 25*a* to 25*d* has an outlet opened between the projected line 200 and the outer line 201. The inlet of each of through holes 25*a* to 25*d* is spaced by a distance d2, which is greater than or equal to the diameter d1 of the through holes ($d2 \geqq d1$), from the outer line 201. In this embodiment, a significant distance d2. is provided in an inclining direction of the each through hole and in a radial direction. Therefore, the chamber 51 is extended a distance that is greater than the diameter d1 radially beyond the through holes.

When the coil 41 is not energized, the spring 35 pushes the needle 20 toward the seat 14*a*, the seat 14*a* and the contact portion 21 closes the fuel passage 50.

When the coil 41 is energized, the coil 41 generates an electromagnetic force between the stator core 30 and the armature core 31 and attracts the armature 31 and the needle 20 to lift up the needle 20. Therefore, the fuel passage 50 is opened to inject fuel.

Fuel flowing into the chamber 51 is divided into a first flow toward a center of the chamber 51 and a second flow toward radial outside of the chamber 51. The first flow meets and collides at a center of the plate 25 and turns into the radial outside. As a result, the first flow has a lot of turbulences. A part of the second flow and the turned first flow reaches to the inlets of the through holes after flowing along the plate 25. A remaining part of the second flow and the turned first flow passes between the inlets of the through holes and reaches to the outer end of the chamber 51. After that, the remaining part of the second flow changes its direction and reaches to the inlets of the through holes. Here, a distance d2 is wider than the diameter of the through holes to provide a passage on an outer side which is sufficient to provide a counter flow flowing radially from an outside to an inside. Therefore, fuel guided along the plate 25 flows into the inlets from all directions evenly. Fuel collides at just above the inlets and makes a lot of turbulences in the column of the injected fuel. Therefore, each of the columns of the injected fuel from the through holes 25*a* to 25*d* are atomized finely. Additionally, the columns of the injected fuel don't collide each other, since four through holes are separately arranged.

Figure 4:
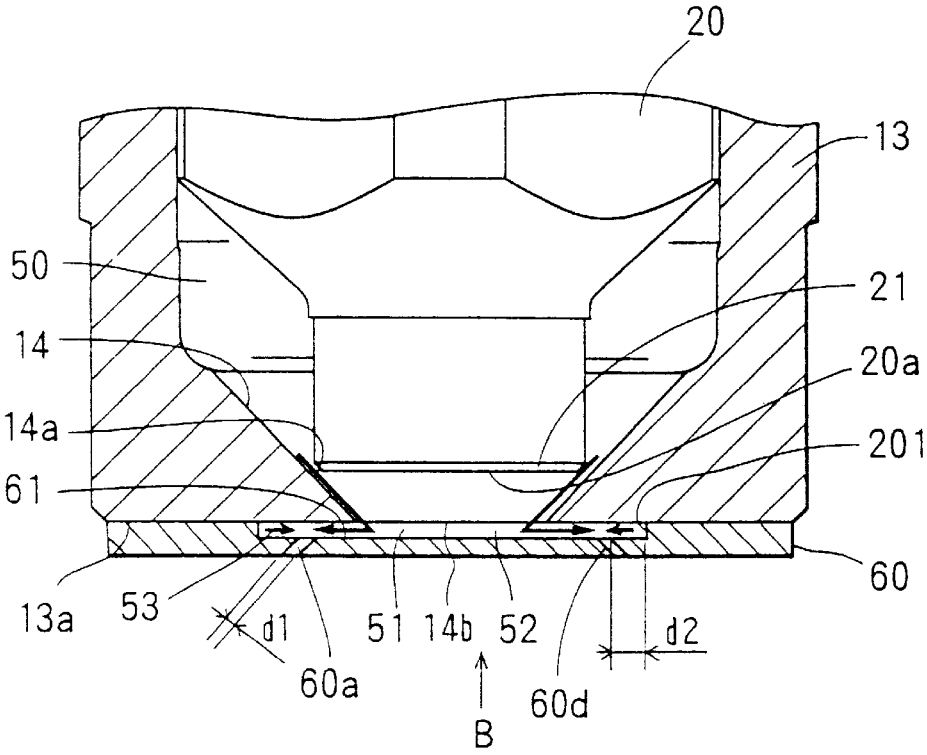
FIG. 4 is a partial sectional view of a nozzle portion of a fuel injector according to a second embodiment of the present invention.
Figure 5:
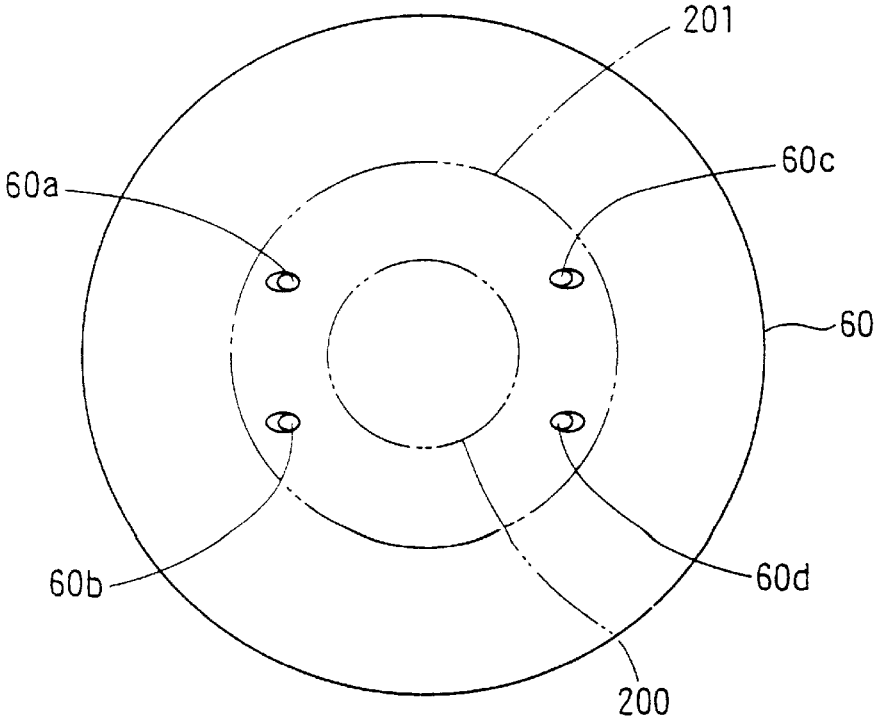
FIG. 5 is a bottom view of a plate according to the second embodiment of the present invention.

FIGS. 4 and 5 show a second embodiment of the present invention. Hereinafter, the same or equivalent component as the above-mentioned embodiment is indicated by the same reference numerals and characterizing portions of each embodiment will be explained.

In this embodiment, a depression is formed on an upper surface of the plate 60 to provide the chamber 51. The through holes 60*a* to 60*d* are similar to the through holes 25*a* to 25*d* of the first embodiment.

Figure 6:
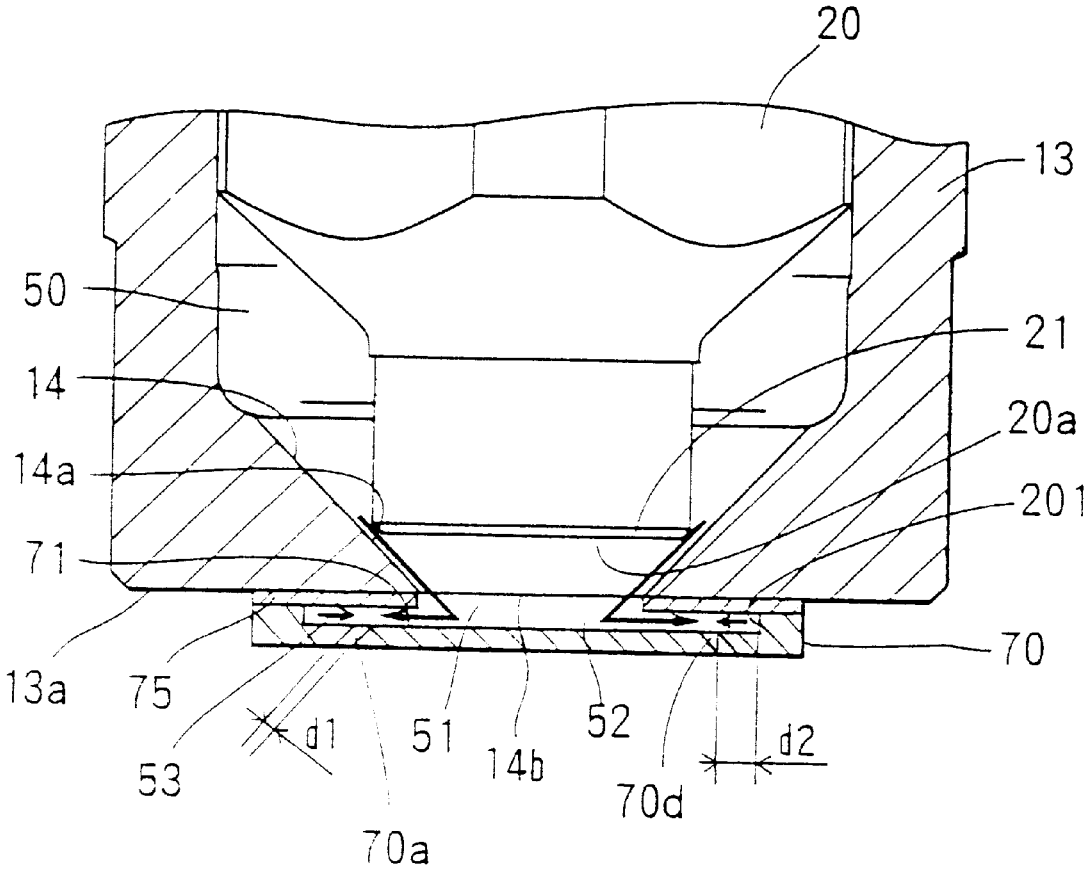
FIG. 6 is a partial sectional view of a nozzle portion of a fuel injector according to a third embodiment of the present invention.

FIG. 6 shows a third embodiment of the present invention. In this embodiment, a plate 70 and a plate 75 are fixed on the bottom surface 13*a* of the valve body 13. The plate 70 has a depression and through holes which are similar to the second embodiment. The plate 75 is disposed between the valve body 13 and the plate 70 for providing an opening 75*a* having the same diameter as the opening 14*b*. The plate 70 has the through holes 70*a* to 70*d* similar to the thorough holes 25*a* to 25*d* of the first embodiment. In this embodiment, fuel guided by the inner surface 14*a* reaches more inner side of the chamber 51, and changes a flow direction. Further, it is possible to form the chamber precisely.

Figure 7:
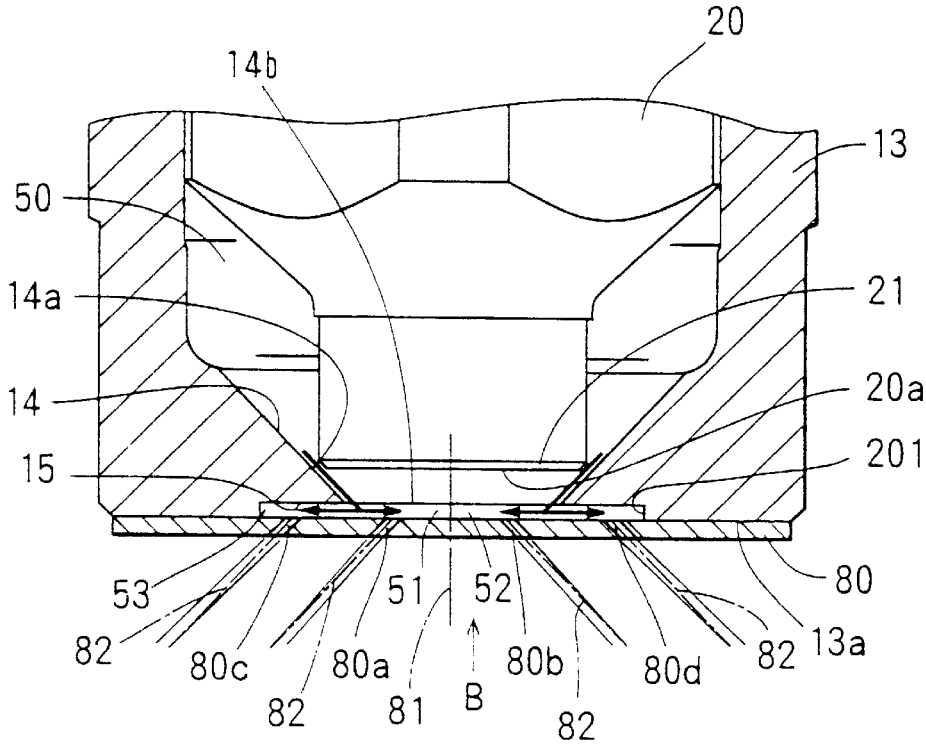
FIG. 7 is a partial sectional view of a nozzle portion of a fuel injector according to a fourth embodiment of the present invention.
Figure 8:
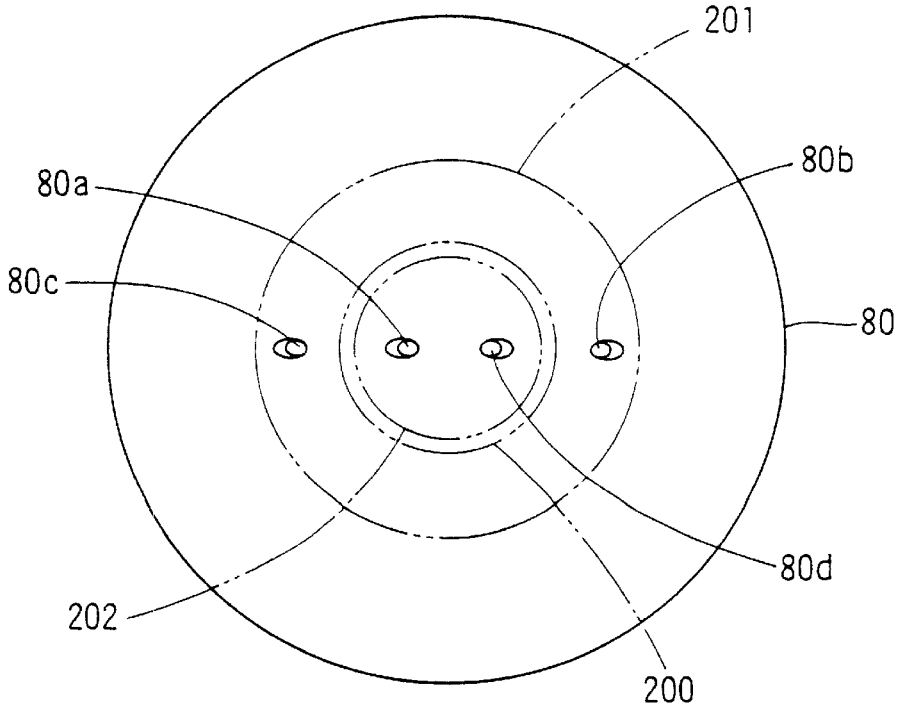
FIG. 8 is a bottom view of a plate according to the fourth embodiment of the present invention.

FIG. 7 and 8 show a fourth embodiment of the present invention. In this embodiment, the plate has four through holes 80*a*, 80*b*, 80*c* and 80*d*. The through holes 80*a* and 80*b* are arranged inside of an imaginary line 202 on an upper surface of the plate 80 and form inner through holes. The through holes 80*c* and 80*d* are arranged outside of the imaginary line 202 and form outer through holes. Here, the imaginary line 202 is defined as a circular line where a line extended along the inner surface 14 crosses the upper surface of the plate 80. The imaginary line 202 also indicates a portion where fuel flowing along the inner surface 14 directly collides with the plate 80. Therefore, the imaginary line 202 appears inside of the projected line 200. The through hole 80*a* of the inner holes and the through hole 80*c* of the outer holes are inclined toward a left side. The through hole 80*b* of the inner holes and the through hole 80*d* of the outer holes are inclined toward a right side.

In this embodiment, fuel flowing along the inner surface 14 is divided into a first flow toward the inner holes 80*a* and

80*b* and a second flow toward the outer holes 80*c* and 80*d*. Here, each of a paired through holes 80*a* and 80*c* mainly receives opposed flows. Therefore, fuel jet formed by the thorough hole 80*a* is influenced by the first flow so that the jet inclines inside from an axis 82 of the hole 80*a*. On the other hand, fuel jet formed by the thorough hole 80*c* is influenced by the second flow so that the jet inclines outside from an axis 82 of the hole 80*c*. As a result, a pair of jets injected from a pair of holes 80*a* and 80*c* are separated to avoid a collision of the fuel jets. In the through holes 80*b* and 80*d*, the same function is achieved.

Figure 9:
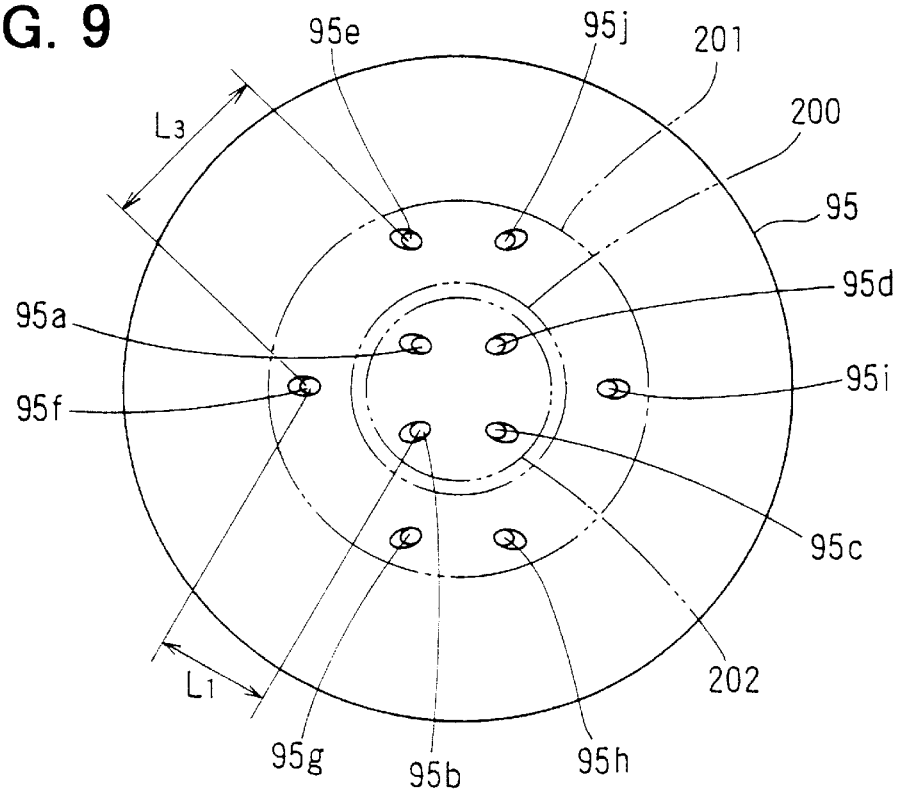
FIG. 9 is a bottom view of a plate according to a fifth embodiment of the present invention.

FIG. 9 shows a fifth embodiment of the present invention. In this embodiment, a plate 95 has ten through holes 95*a* to 95 95*j*. The through holes 95*a* to 95*d* form inner through holes. The through holes 95*e* to 95*j* form outer through holes. The through holes 95*a*, 95*b*, 95*e*, 95*f* and 95*g* form a group of through holes directed in a left side. The through holes 95*c*, 95*d*, 95*h*, 95*i* and 95*j* form a group of through holes directed in a right side. In this embodiment, inner through holes and outer through holes being member of one group are distanced at least L1. The outer through holes being member of one group are distanced at least L3 which is wider than the distance L1. Therefore, a collision of the jets injected from the outer through holes is avoided even the second flow is influenced on both of the adjacent outer through holes.

Figure 10:
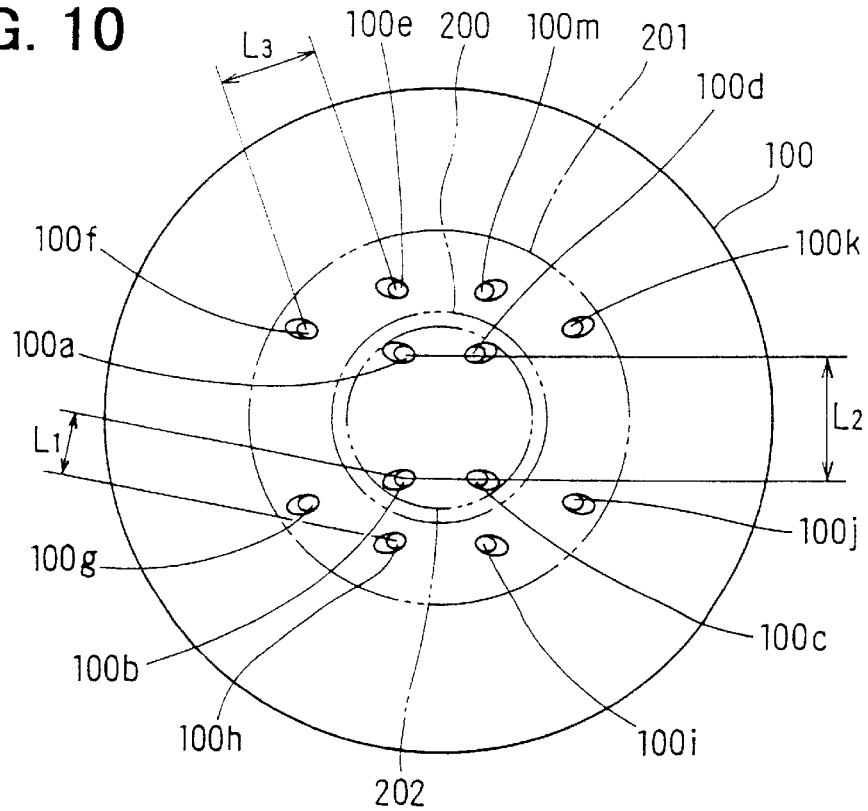
FIG. 10 is a bottom view of a plate according to a sixth embodiment of the present invention.

FIG. 10 shows a sixth embodiment of the present invention. In this embodiment, a plate 100 has twelve through holes 100*a* to 100*k* and 100*m*. The through holes 100*a* to 100*d* form inner through holes. The through holes 100*e* to 100*k* and 100*m* form outer through holes. The through holes 100*a*, 100*b*, 100*e*, 100*f*, 100*g* and 100*h* form a group of through holes directed in a left side. The through holes 100*c*, 100*d*, 100*i*, 100*j*, 100*k* and 100*m* form a group of through holes directed in a right side. In this embodiment, the inner through holes being member of one group are distanced at least L2 which is wider than L1. Therefore, a collision of the jets injected from the inner through holes is avoided even the first flow is influenced on both of the adjacent inner through holes.

Figure 11:
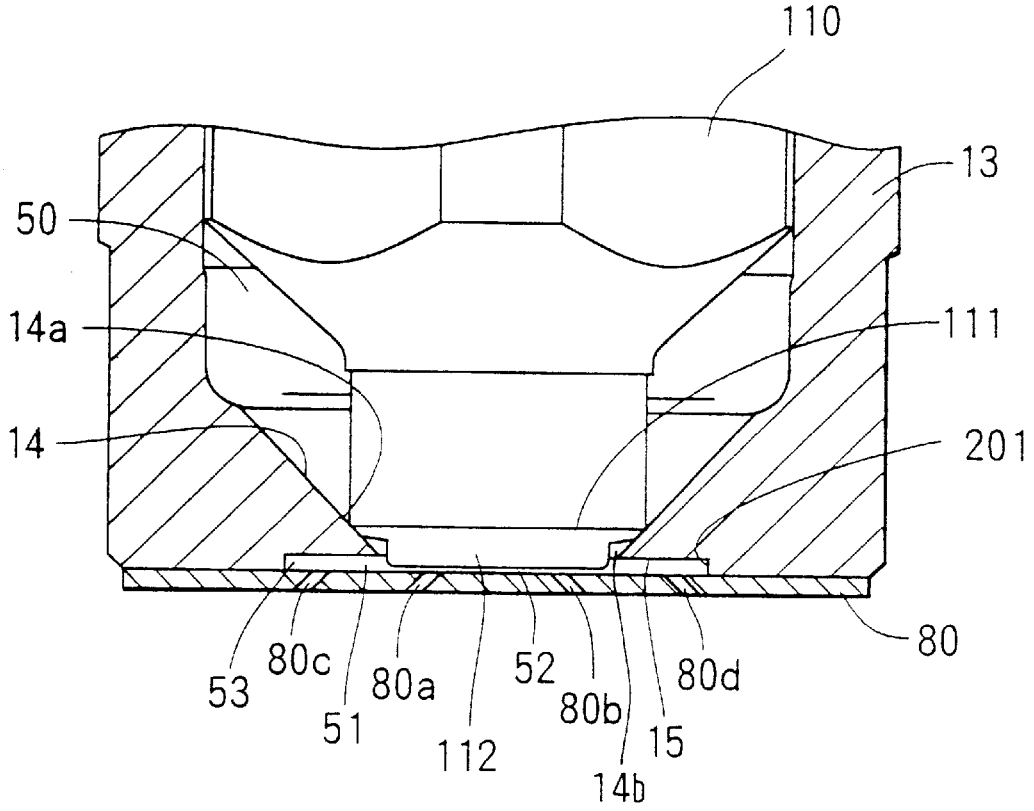
FIG. 11 is a bottom view of a plate according to a seventh embodiment of the present invention.

FIG. 11 shows a seventh embodiment of the present invention. In this embodiment, the needle is indicated by a reference 110. The contact portion in indicated by a reference 111. The needle 111 additionally has a protrusion 112 thereon. The protrusion 112 decreases a capacity of the inner chamber 52 and provides a flat wall facing the inlets of the inner through holes 80*a* and 80*b*. It is possible to reduce a remaining fuel in the chamber and improve an accuracy of a fuel measurement. Such a protrusion may be used for the above-mentioned embodiments.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fluid injection nozzle having a plate with orifices comprising:

a valve body providing a valve seat on an inner surface, said inner surface defining a fluid passage;

a valve member for cooperating with said valve seat to open and close said fluid passage; and a plate disposed on a downstream side of said fluid passage, said plate having at least four through holes as orifices for injecting fluid and for defining a shape of injected fluid, said plate providing a chamber just above said through holes, wherein said chamber being defined by an approximately flat surface of said plate and being extended substantially in parallel with said plate, and wherein said chamber is larger than a downstream end opening of said inner surface of said valve body, and wherein at least two of said through holes have inlets opened at an area outside a projected area of said downstream end opening in an axial direction, and are inclined away from an axis of said nozzle at a downstream side, and wherein said chamber is extended outwardly beyond said through holes by a distance d2 more than a diameter d1 of said through holes.

2. The fluid injection nozzle having a plate with orifices according to claim 1, wherein said valve body has a depression on its downstream end for defining said chamber, and said inlets opened at said outside area face a bottom surface of said depression.

3. The fluid injection nozzle having a plate with orifices according to claim 1, wherein said plate has a depression on its upstream side for defining said chamber, and said inlets opened at said outside area face a bottom surface of said valve body or another plate disposed between said plate and said valve body.

4. The fluid injection nozzle having a plate with orifices according to claim 1, wherein all of said through holes are inclined at a predetermined angle away from an axis of said nozzle at a downstream side.

5. The fluid injection nozzle having a plate with orifices according to claim 4, wherein said predetermined angle is set between 2° and 40°.

6. The fluid injection nozzle having a plate with orifices according to claim 1, wherein said valve member has a protrusion protruding into said chamber.

7. The fluid injection nozzle having a plate with orifices according to claim 1, wherein said valve member has a flat surface facing said chamber.

8. The fluid injection nozzle having a plate with orifices according to claim 1, wherein said fluid passage has a funnel-shaped surface having a cross sectional area that decreases toward a downstream side, and wherein said funnel-shaped surface and said plate are arranged so that fluid flowing on said funnel-shaped surface flows directly onto an upper surface of said plate.

9. The fluid injection nozzle having a plate with orifices according to claim 1, wherein said inner surface of said valve body has a surface part defining an acute angle with a surface defining an upside wall of said chamber.

10. The fluid injection nozzle having a plate with orifices according to claim 1, wherein said chamber is a circular shape.

11. The fluid injection nozzle having a plate with orifices according to claim 1, wherein said plate is a circular disc shape.

12. The fluid injection nozzle having a plate with orifices according to claim 1, wherein said plate is fixed in place by a welding.

13. The fluid injection nozzle having a plate with orifices according to claim 12, wherein said chamber is a circular shape.

14. The fluid injection nozzle having a plate with orifices according to claim 13, wherein said through holes define a plurality of groups in accordance with inclined directions, each group including at least two of said through holes.

15. The fluid injection nozzle having a plate with orifices according to claim 14, wherein each group includes at least two of said through holes that have said inlets opened at said outside area.

16. The fluid injection nozzle having a plate with orifices according to claim 14, wherein each group includes at least one through hole that has an inlet opened inside of said projected area.

17. The fluid injection nozzle having a plate with orifices according to claim 13, wherein all of said through holes are circular holes inclined away from said axis of said nozzle, and have inlets that are wider in a radial direction than circumferentially with respect to the axis of the nozzle.

18. The fluid injection nozzle having a plate with orifices according to claim 1, wherein at least two of said through holes have inlets opened at an area inside said projected area of said downstream end opening, and are inclined away from an axis of said nozzle at a downstream side.

19. The fluid injection nozzle having a plate with orifices according to claim 1, wherein the inlets located in the outside area are located close to a circle diametrically corresponding to the valve seat or are located on an outside of the circle.

20. A fluid injection nozzle having a plate with orifices comprising:

a valve body which has a fluid passage therein, the fluid passage defining a valve seat and an opening at a downstream end thereon, the fluid passage further defining a funnel-shaped portion of which a cross sectional area decreases in a downstream direction;

a valve member for cooperating with the valve seat to open and close the fluid passage; and a circular plate disposed on an end of the valve body by a welding, the plate defining a thin, flat and circular chamber between the opening of the fluid passage and an upper surface thereon, the chamber having a diameter larger than that of the opening of the valve body, the plate having at least four circular through holes as orifices for injecting fluid and for defining a shape of injected fluid, the through holes having inlets located on an upper surface of the plate and outlets located on a bottom surface of the plate, at least two of the inlets being located in an area outside a projected area of the opening of the valve body in an axial direction, wherein the through holes are outwardly inclined from an axis of the nozzle in a flow direction, and the inlets located in the outside area are located close to a circle diametrically corresponding to the valve seat or are located on an outside of the circle.

* * * * *